US006059700A

United States Patent [19]

Ellenburg

[11] Patent Number: 6,059,700

[45] Date of Patent: May 9, 2000

[54] LOCKING SYSTEM FOR BARBELLS

[75] Inventor: Howard S. Ellenburg, Boulder, Colo.

[73] Assignee: Ultima Fitness, Inc., Denver, Colo.

[21] Appl. No.: 09/018,101

[22] Filed: Feb. 3, 1998

[51] Int. Cl.[7] ..... A03B 21/075

[52] U.S. Cl. ..... 482/107; 482/108

[58] Field of Search ..... 482/93, 106–109; 403/325, 328, 322.2, 109.3, 109.6, 109.8

[56] References Cited

U.S. PATENT DOCUMENTS

| | | | |
|---|---|---|---|
| 1,672,944 | 6/1928 | Jowett . | |
| 1,991,520 | 2/1935 | Postl . | |
| 2,640,696 | 6/1953 | Lemieux . | |
| 4,047,779 | 9/1977 | Klancnik | 403/189 |
| 4,569,105 | 2/1986 | Weider . | |
| 4,579,337 | 4/1986 | Uyeda . | |
| 4,638,994 | 1/1987 | Gogarty . | |
| 4,662,771 | 5/1987 | Rue et al. | 403/322.2 |
| 4,859,110 | 8/1989 | Dommel | 403/325 |
| 4,893,810 | 1/1990 | Lee . | |
| 4,948,123 | 8/1990 | Schook . | |
| 5,024,434 | 6/1991 | Smith . | |
| 5,163,887 | 11/1992 | Hatch | 482/107 |
| 5,346,449 | 9/1994 | Schagel | 482/107 |

FOREIGN PATENT DOCUMENTS

| | | | |
|---|---|---|---|
| 1618430 | 1/1991 | U.S.S.R. | 482/108 |
| 238831 | 8/1925 | United Kingdom . | |

*Primary Examiner*—John Mulcahy

*Attorney, Agent, or Firm*—Townsend and Townsend and Crew LLP

[57] ABSTRACT

The invention provides an exemplary barbell system and methods for its use and construction. The barbell system comprises a handle having a pair of ends, and a pair of end pieces which are receivable into each of the ends. The end pieces are adapted to couple a weight to the handle. A releasable coupling mechanism is provided at each of the ends to releasably couple each end piece to the handle. Further, a locking mechanism is provided and is receivable about the handle to lock the coupling mechanism in a locked position.

28 Claims, 5 Drawing Sheets

LOCKING SYSTEM FOR BARBELLS

BACKGROUND OF THE INVENTION

The invention relates generally to the field of weightlifting, and in particular to barbells having releasable weights. More specifically, the invention provides for the locking of weights to a barbell to prevent their unwanted release.

An improved barbell system for releasably securing weights to a handle is described in U.S. Pat. No. 5,346,449 (the '449 patent), the complete disclosure of which is herein incorporated by reference. Briefly, the barbell system of the '449 patent includes a tubular handle and a pair of plunger pieces which are insertable into the ends of the handle. A collar is provided at each end of the handle for securing the plunger pieces to the handle.

With such a configuration, the user is able to attach a ring-shaped weight to the handle by inserting one of the plunger pieces through the weight and then inserting the plunger piece into the handle. Each plunger piece is advanced into the handle until the collar causes a set of balls to grip the plunger piece, thereby securing the plunger piece to the handle.

The barbell system of the '449 patent has proven to be tremendously successful. However, as with many inventions, it would be desirable to provide improvements to enhance the product. For example, it would be desirable in some cases to improve the construction of the barbell system so that it would have the capacity to safely hold more weight. Further, it would be desirable to provide a way to lock the collar to prevent inadvertent release of the weights. Such an improvement should be easy to use so that a weightlifter can easily and conveniently lock and release the weights. Further, it would be desirable if such improvements were cost effective so that the barbell system may remain commercially competitive. Providing such improvements in this manner can be especially challenging, particularly when the handle is constructed of a metallic material which increases the cost of the barbell.

Hence, it would be desirable to provide an improved barbell system and methods for making such a barbell system which is more durable and rugged, thereby being able to hold more weight. Further, the improved system should be both easy to use and economically competitive so that the barbell system will be commercially successful in the fitness equipment market.

SUMMARY OF THE INVENTION

The invention provides an improved barbell system and methods for making and using such a barbell system. In one exemplary embodiment, a barbell system is provided which comprises a handle having a pair of ends. The pair of end pieces are receivable into each of the ends so that weights may be coupled to the handle by inserting the end pieces through the weights and then inserting the end pieces into the handle. A releasable coupling mechanism is provided at each of the ends to releasably couple each end piece to the handle. A locking mechanism is further provided and is receivable about the handle to lock the coupling mechanism in a locked position. In this way, the locking mechanism will prevent undesirable operation of the coupling mechanism so that the weights will remain securely attached to the handle.

Preferably, the locking mechanism is expandable so that it may be placed over the handle. In one exemplary aspect, the locking mechanism comprises a fluted ring which is expandable so that it may be inserted over the handle. In still another exemplary aspect, the handle is constructed of a metallic tubular body and the fluted ring is constructed of a plastic material. In this way, a cost effective way is provided for implementing a locking mechanism on the metallic tubular body. More specifically, to assemble the locking mechanism the fluted ring is simply expanded and placed over the metallic tubular body where the ring constricts itself about the tubular body.

In another aspect, the coupling mechanism comprises a collar and at least one ball that is disposed in the handle. The collar forces the ball into engagement with the end piece when locked in the locked position. Preferably, the collar includes a stepped slot and the locking mechanism includes a locking projection which is receivable into the slot to lock the collar in the locked position. A spring or other biasing mechanism is provided to bias the collar in the locked position. Further, the locking mechanism includes an extension to engage the spring. In this way, the stepped slot on the collar is biased into engagement with the locking projection on the locking mechanism so that the collar cannot be operated to release the weight until the collar is rotated against the force of the spring to move the locking projection out of engagement with the stepped slot.

In yet another exemplary aspect, the locking mechanism includes a detent which is receivable into an aperture in the handle. The detent prevents rotation of the locking mechanism relative to the handle. Preferably, the handle includes a groove to receive the ring. Such a groove facilitates easy attachment of the ring in the proper position on the handle. Conveniently, a fluted washer is receivable over the handle to prevent removal of the coupling mechanism from the handle.

The invention further provides an exemplary method for making a barbell. According to the method, a handle is provided having a pair of ends. A locking mechanism is placed about the handle and a coupling mechanism is inserted over the handle so that it at least partially passes over the locking mechanism. Further, the coupling mechanism is biased so that the coupling mechanism engages the locking mechanism in a locked position. The coupling mechanism is both rotated and translated until the locking mechanism is released. An end piece is then inserted into the handle. At this point, the coupling mechanism may be released to allow the coupling mechanism to return to the locked position. In this way, the end piece will be securely coupled to the handle until the coupling mechanism is rotated and translated to disengage the locking mechanism.

In one preferable aspect, the locking mechanism is outwardly expanded to place the locking mechanism about the handle. Such outward expansion of the locking mechanism is facilitated by constructing the locking mechanism out of a fluted ring. In this way, the ring may be radially expanded to place the locking mechanism upon the handle.

In an additional step, a fluted washer is placed about the handle after inserting the coupling mechanism. In this way, the washer prevents removal of the coupling mechanism from the handle.

The locking mechanism preferably includes a projection and a slot is provided in the coupling mechanism to receive the projection when in the locked position. The coupling mechanism is preferably biased in the locked position with a spring, and an extension is provided on the locking mechanism to engage the spring. A detent may also be provided on the locking mechanism to prevent rotation of the locking mechanism relative to the handle.

DETAILED DESCRIPTION OF THE SPECIFIC EMBODIMENTS

The invention provides an exemplary barbell system and methods for making such a barbell system. One particular feature of the barbell system is the use of a locking mechanism which is configured to lock a coupling mechanism in a locked position. Although useful with a wide variety of barbell systems, the locking mechanism of the invention will find its greatest use with barbell systems employing a metallic handle. The locking mechanism preferably comprises an expandable ring, washer, or the like, which may be expanded to be placed about the handle so that it may lock the coupling mechanism in place. The locking mechanism is preferably constructed of a plastic material and is fluted to facilitate its expansion and placement over the handle. By constructing the locking mechanism in this way, the cost of including a locking mechanism on a metallic handle is greatly reduced. Hence, a cost effective way is provided for preventing unwanted release of weights from the handle during use.

Figure 1:
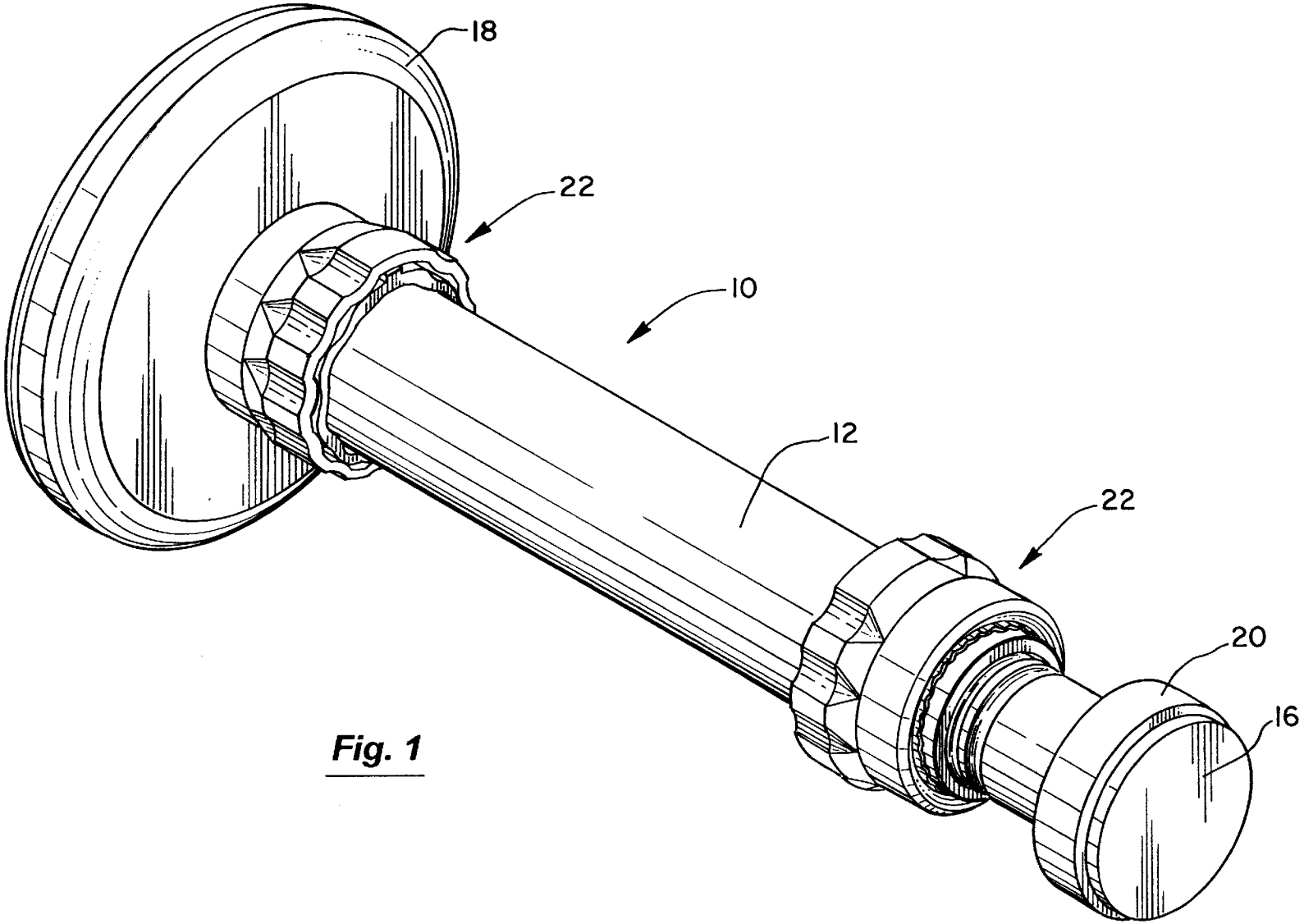
FIG. 1 is a perspective view of an exemplary barbell system according to the invention.
Figure 2:
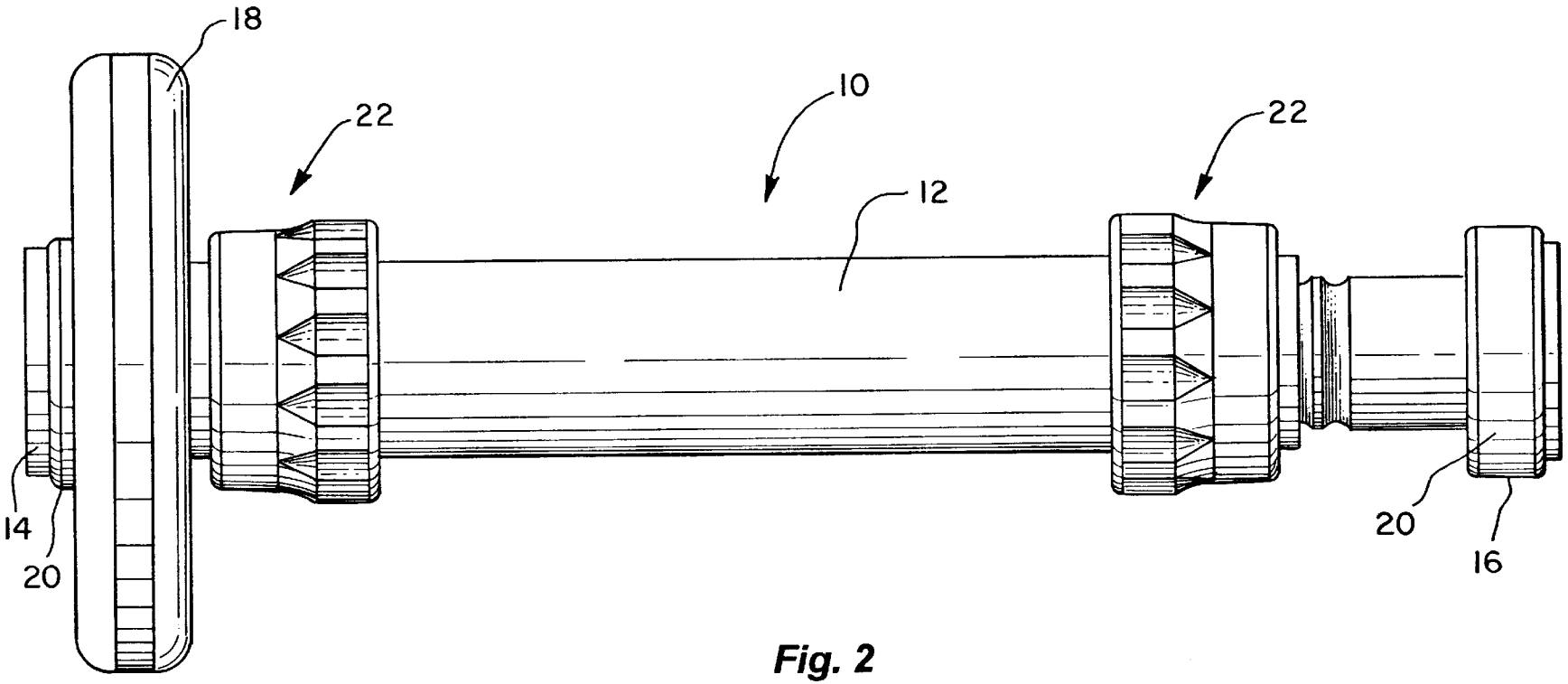
FIG. 2 is a side view of the barbell system of FIG. 1.

Turning now to the drawings, an exemplary embodiment of a barbell system 10 will be described. As shown in FIGS. 1 and 2, barbell system 10 comprises an elongate handle 12 to which a pair of end pieces 14 and 16 are coupled. In turn, end pieces 14 and 16 are employed to secure one or more weights 18 to handle 12. For convenience of discussion, only one weight is shown secured to handle 12 by end piece 14.

Figure 3:
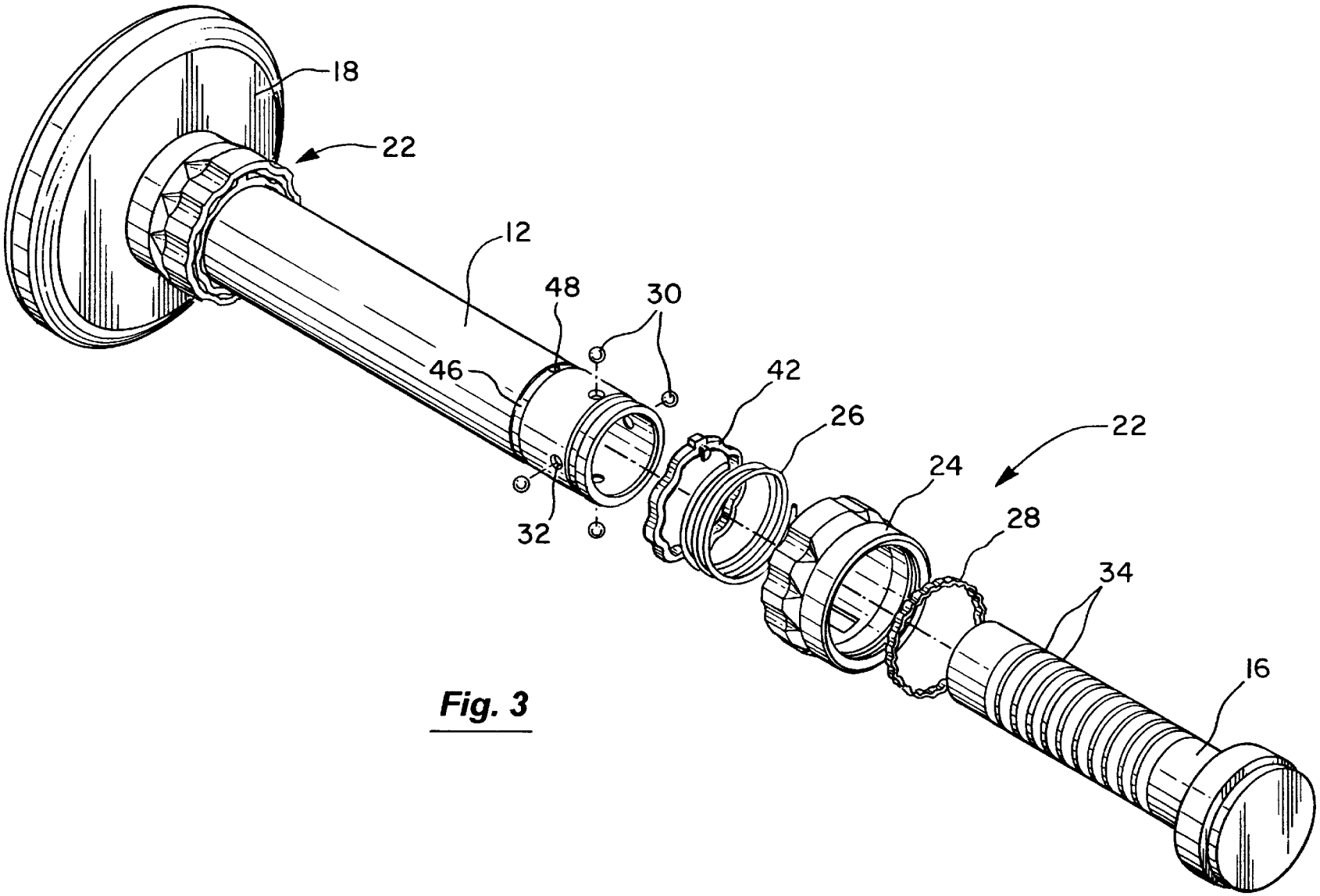
FIG. 3 is an exploded view of the barbell system of FIG. 1 showing the elements of a coupling mechanism and a locking mechanism.
Figure 4:
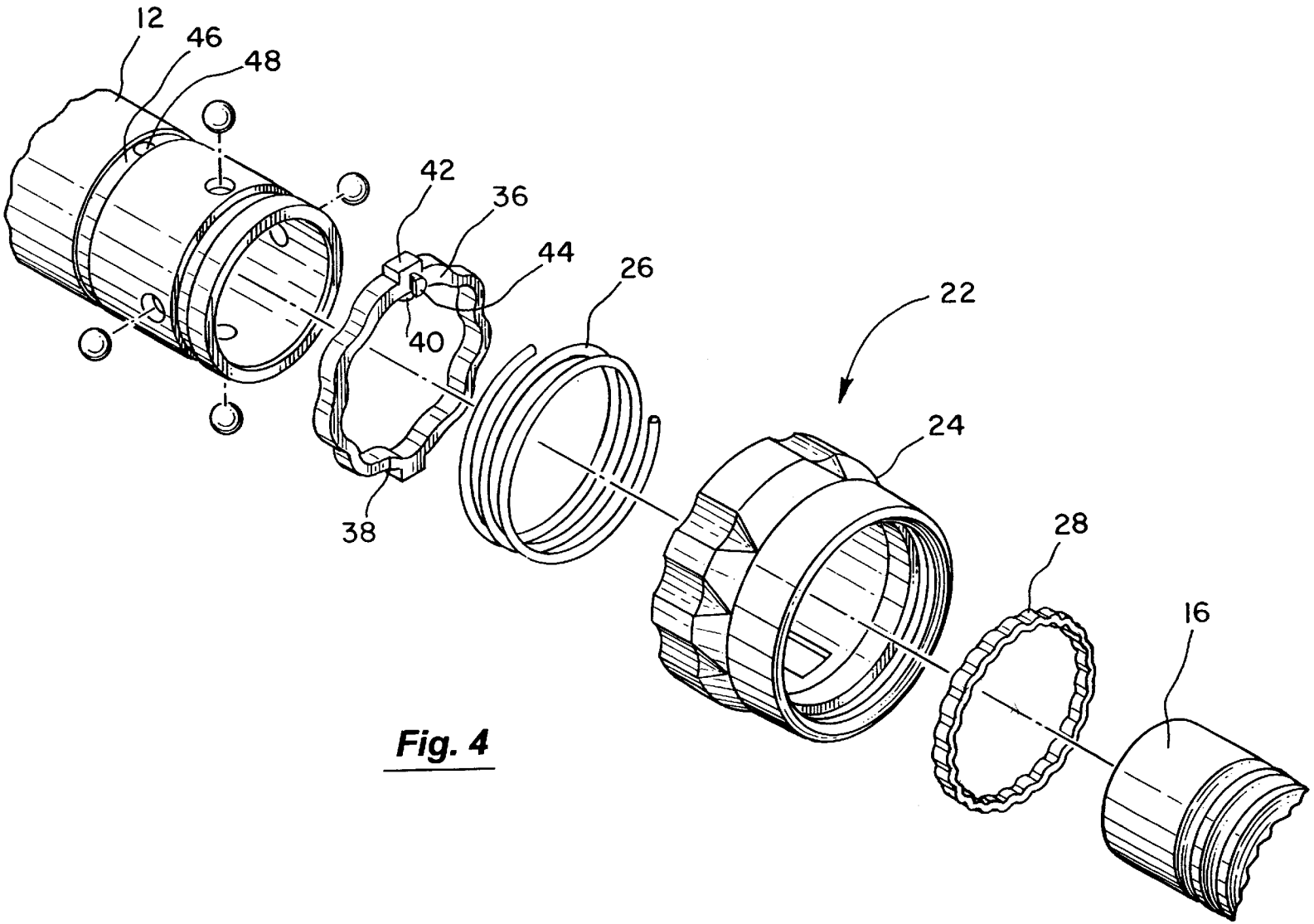
FIG. 4 is a more detailed view of the elements illustrated in FIG. 3.

Handle 12 is preferably constructed of a metallic material, with the preferred metal being chrome plated steel. However, other rigid materials may also be used to construct handle 12, including plastics, ceramics, composites, and the like. As best shown in FIGS. 3 and 4, handle 12 is tubular (at least at its ends) so that end pieces 14 and 16 may be inserted into handle 12 as shown in FIGS. 1 and 2. Conveniently, end pieces 14 and 16 each include a resilient pad 20 which is compressible to facilitate attachment of weight 18 to handle 12.

End pieces 14 and 16 are coupled to handle 12 with a pair of coupling mechanisms which are identified generally by reference numeral 22. As best shown in FIGS. 3 and 4, each coupling mechanism 22 comprises a collar 24, a spring 26, a locking washer 28 and a plurality of balls 30. Balls 30 are disposed within apertures 32 in handle 12. End pieces 14 and 16 each include circular grooves 34 into which balls 30 are received when being forced radially inward by collar 24. More specifically, when collar 24 is inserted over handle 12, collar 24 will eventually engage balls 30 and force them radially inward through apertures 32 until the balls rest within one of the grooves 34. In this way, end pieces 14 will be prevented from being removed from handle 12 until collar 24 is slid out of engagement from balls 30.

Figure 5:
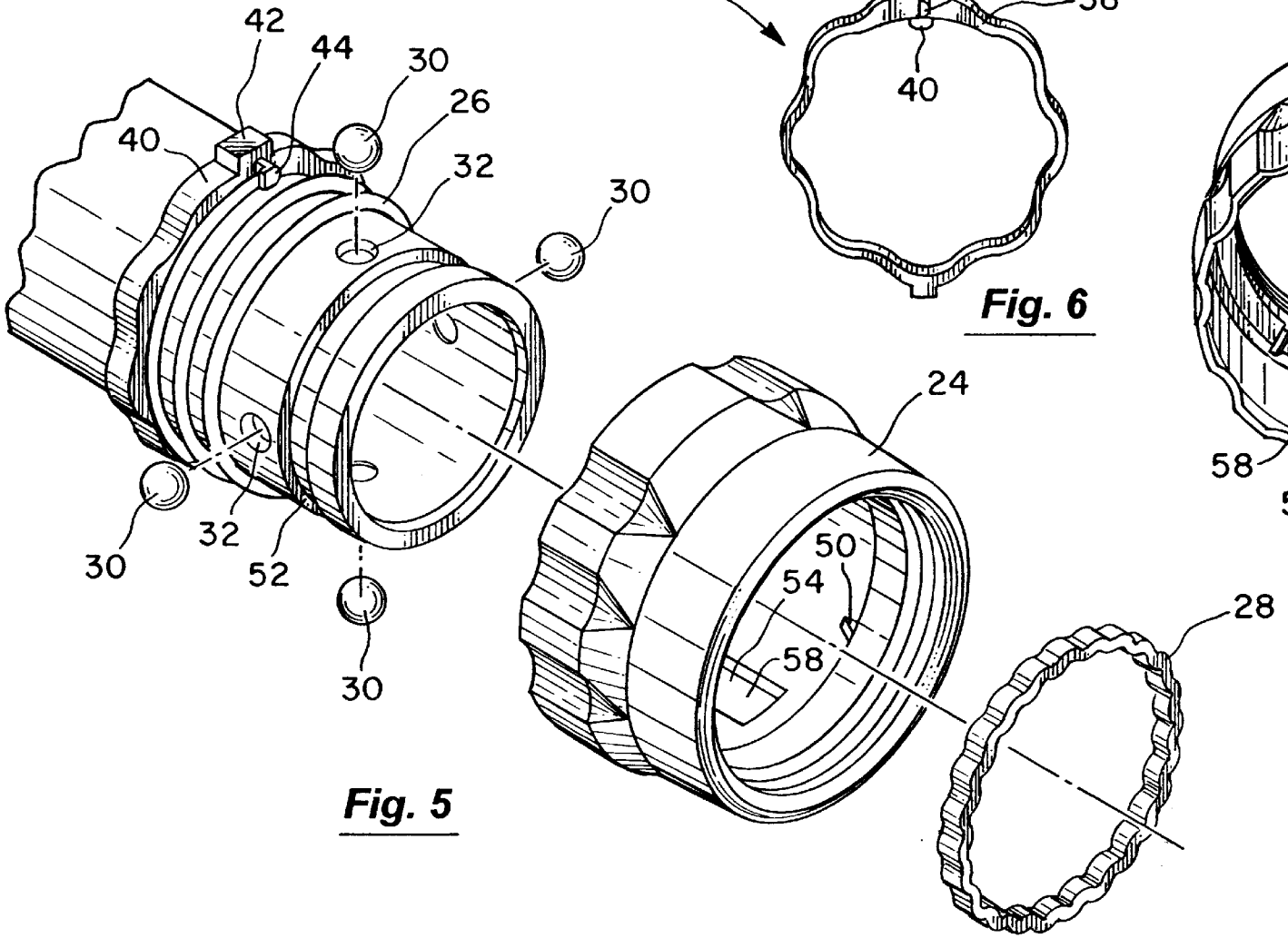
FIG. 5 illustrates a method for attaching the locking mechanism and coupling mechanism of FIGS. 3 and 4 onto a handle according to the invention.

Still referring to FIGS. 3 and 4, barbell system 10 further includes a locking mechanism 36 which interacts with coupling mechanism 22 to maintain the coupling mechanism in a locked position and to prevent unwanted release of end pieces 14 from handle 12. Locking mechanism 36 comprises a fluted ring 38 having a detent 40, a locking projection 42, and an extension 44. Fluted ring 38 is preferably constructed of a material that may be expanded so that ring 38 may be inserted over handle 12 as illustrated in FIG. 5. Exemplary materials for constructing ring 38 comprise plastics, metals, composites, and the like. The fluted nature of ring 38 facilitates its expansion so that it may be expanded to be inserted over handle 12. Moreover, once positioned at the proper place on handle 12, the resilient nature of the material used to construct ring 38 will cause it to compress itself about handle 12 so that it will remain in a generally stationary position. Although shown as a continuous ring, it will be appreciated that locking mechanism 36 may be constructed of other geometries and configurations that may be inserted over handle 12. For example, locking mechanism 36 could be in the configuration of a C clip, a snap ring, and the like.

One particular advantage of fabricating locking mechanism 36 separate from handle 12 is that handle 12 may be constructed of a metallic or other rigid material while locking mechanism 36 is constructed of a relatively inexpensive material that may be simply inserted over handle 12. In this way, the need to mill a locking mechanism out of a steel rod or tubing is eliminated, thereby greatly reducing the cost of the overall barbell system.

As illustrated in FIG. 4, handle 12 includes a circular groove 46 into which ring 38 is received. Groove 46 includes a hole or depression 48 into which detent 40 is received. In this way, rotation of ring 38 relative to handle 12 will be prevented. Optionally, an expansion tool may be used to expand ring 38 when placing ring 38 about handle 12.

Referring now to FIG. 5, attachment of coupling mechanism 22 to handle 12 will be described. Initially, locking mechanism 36 is placed in groove 46 as previously described. Spring 26 is then inserted over handle 12 as shown. Spring 26 is adjusted so that one of its ends engages extension 44 on locking mechanism 36. Balls 30 are inserted into apertures 32 and collar 24 is inserted over handle 12. Collar 24 is adjusted until the opposite end of spring 26 engages an extension 50 on collar 24. Locking washer 28 is then inserted over handle 12 until received within a groove 52 in handle 12. In this way, collar 24 will be prevented from being removed from handle 12. Conveniently, the edge of groove 52 which is closest to the end of handle 12 will be tapered to facilitate sliding of washer 28 into groove 52. The opposite side of groove 52 will preferably be generally perpendicular to the elongate axis of handle 12 to prevent washer 28 from being slid too far over handle 12 during insertion.

Locking washer 28 is preferably fluted so that it may be expanded to be placed over handle 12 in a manner similar to ring 38. As such, washer 28 may be constructed of materials and configured to be similar to ring 38.

Figure 7:
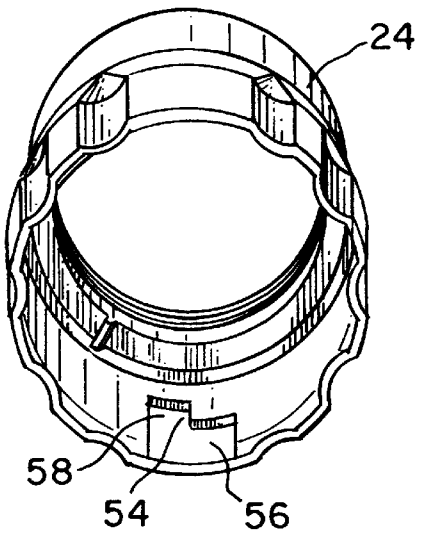
FIG. 7 is an end perspective view of a collar of the coupling mechanism of FIG. 3.
Figure 6:
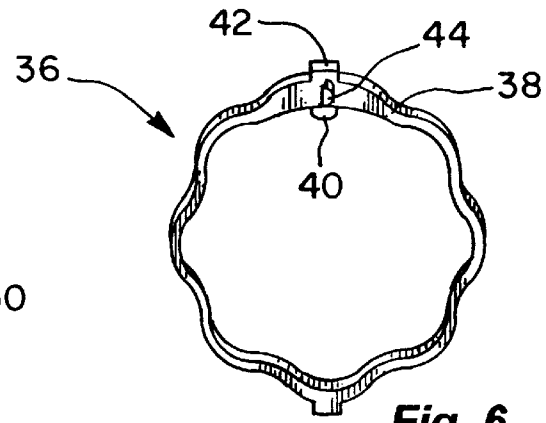
FIG. 6 is an end perspective view of the locking mechanism of FIG. 3.

As best shown in FIG. 7, collar 24 includes a stepped slot 54 having a first step 56 and a second step 58. When placing collar 24 over handle 12, one of locking projections 42 is inserted into first step 56. Such a configuration is a locked position where collar 24 forces balls 30 into grooves 34 of end pieces 14 and 16 to securely couple the end pieces to handle 12. Moreover, the force of spring 26 holds collar 24 in the locked position to prevent release of the weights. To insert or remove end pieces 14 and 16 to or from handle 12, collar 24 is rotated in a clockwise direction (as indicated by the arrow in FIG. 5) against the force of spring 26 and then pushed toward the center of handle 12 (to compress spring 26) so that locking projection 42 enters into step 58. Such a configuration is an unlocked position where end pieces 14 and 16 are able to be inserted into and removed from handle 12. To facilitate the sliding of collar 24 over projection 42, collar 24 is preferably constructed of a plastic material, such as nylon, so that collar 24 is easy to rotate.

In summary, the invention provides a convenient and cost effective locking mechanism to securely lock a coupling mechanism in a locked position. Such a coupling mechanism in turn is employed to couple an end piece to the handle of a barbell system. The locking mechanism is preferably a separate element from the handle so that it may be manufactured of a relatively inexpensive material and then disposed about the handle. In operation, a user inserts one of the end pieces 14 or 16 through a ring weight and then inserts the end piece into handle 12. At the same time, collar 24 is rotated clockwise and pressed inward toward the center of handle 12 to place projection 42 in step 58. The user then presses on end piece 14 to slightly compress pad 20 and so that one of the grooves 34 is aligned with balls 30. Collar 24 is then released, with spring 26 forcing projection 42 into step 56. At this point, collar 24 is in a locked position so that the weights will be prevented from being removed from handle 12. When it is desired to remove or add a weight, collar 24 is rotated in a clockwise direction and pushed toward the center of handle 12 to remove projection 42 from step 58. Such movement releases balls 30 from grooves 34 and allows end piece 14 or 16 to be removed from handle 12.

Hence, locking mechanism 36 provides a convenient way for preventing unwanted release of the weights from handle 12. For example, when a weightlifter performs triceps extensions, spring 26 will prevent clockwise movement of collar 24 and will bias collar 24 in the locked position to prevent unwanted release of the weights. Moreover, since collar 24 must be pushed toward the center of the handle to reach the unlocked position, even if the user's hands slip, the weights will not unexpectedly be released.

The invention has now been described in detail for purposes of clarity of understanding. However, it will be appreciated that certain changes and modifications may be made. Therefore, the scope and content of the invention are not limited by the foregoing description. Rather, the scope and content are to be defined by the following claims.

What is claimed is:

1. A barbell system, comprising:

a handle having a pair of ends;

a pair of end pieces which are receivable into each of the ends, the end pieces being adapted to couple a weight to the handle;

a releasable coupling mechanism comprising a collar at each of the ends, the coupling mechanism releasably coupling each end piece to the handle; and a locking mechanism receivable about the handle to lock the coupling mechanism in a locked position;

wherein the collar is disposed over the handle so as to be rotatable and axially movable relative to the locking mechanism to permit the collar to be first rotated and then moved axially toward a center of the handle to move the coupling mechanism from the locked position and to permit the end piece to be removed from the handle; and wherein the locking mechanism is constructed of an expandable material and is expandable to be received over the handle.

2. A system as in claim 1, wherein the locking mechanism comprises a fluted ring.

3. A system as in claim 2, wherein the handle comprises a metallic tubular body, and wherein the fluted ring is constructed of a plastic material.

4. A system as in claim 2, wherein the handle includes a groove to receive the ring.

5. A system as in claim 1, wherein the coupling mechanism further comprises at least one ball disposed in the handle, wherein the collar forces the ball into engagement with the end piece when locked in the locked position.

6. A system as in claim 5, wherein the collar includes a stepped slot, and wherein the locking mechanism includes a locking projection which is receivable into the slot to lock the collar in the locked position, and wherein the locking mechanism is removable from the slot by rotating the collar and moving the collar toward the center of the handle.

7. A system as in claim 6, further comprising a spring to bias the collar in the locked position, and wherein the locking mechanism includes an extension to engage the spring.

8. A system as in claim 1, wherein the locking mechanism includes a detent which is receivable into an aperture in the handle to prevent rotation of the locking mechanism relative to the handle.

9. A system as in claim 1, further comprising a fluted washer receivable over the handle to prevent removal of the coupling mechanism from the handle.

10. A method for making a barbell, the method comprising:

providing a handle having a pair of ends;

placing a locking mechanism about the handle such that the locking mechanism is non-rotatable relative to the handle;

inserting a coupling mechanism over the handle and over the locking mechanism and biasing the coupling mechanism so that the coupling mechanism engages the locking mechanism in a locked position;

rotating the coupling mechanism until the locking mechanism is released;

inserting an end piece into the handle; and releasing the coupling mechanism to allow the coupling mechanism to return to the locked position.

11. A method as in claim 10, further comprising outwardly expanding the locking mechanism to place the locking mechanism about the handle.

12. A method as in claim 11, wherein the locking mechanism comprises a fluted ring, and further comprising radially expanding the ring to place the locking mechanism about the handle.

13. A method as in claim 10, further comprising inserting a fluted washer about the handle after inserting the coupling mechanism, the fluted washer preventing removal of the coupling mechanism from the handle.

14. A method as in claim 10, wherein the locking mechanism includes a projection, and further comprising providing a slot in the coupling mechanism to receive the projection when in the locked position.

15. A method as in claim 14, further comprising biasing the coupling mechanism in the locked position with a spring, and further comprising providing an extension on the locking mechanism to engage the spring.

16. A method as in claim 15, further comprising providing a detent on the locking mechanism to prevent rotation of the locking mechanism relative to the handle.

17. A method for securing a weight to a barbell, the method comprising:

providing a handle having at least one end;

inserting an end piece through a hole in a weight;

inserting the end piece into the handle;

coupling the end piece to the handle with a coupling mechanism; and locking the coupling mechanism in a locked position to prevent unwanted release of the weight, and wherein the coupling mechanism is locked with a locking mechanism that is received about the handle and engages the coupling mechanism when in the locked position, and wherein the coupling mechanism is unlocked by rotating the coupling mechanism relative to the locking mechanism and then moving the coupling mechanism toward a center of the handle; and further comprising outwardly expanding the locking mechanism to place the locking mechanism about the handle.

18. A method as in claim 17, wherein the locking mechanism comprises a fluted ring, and further comprising radially expanding the ring to place the locking mechanism about the handle.

19. A method as in claim 17, further comprising preventing removal of the coupling mechanism from the handle with a fluted washer that is received about the handle.

20. A method as in claim 17, wherein the locking mechanism includes a projection, and further comprising providing a slot in the coupling mechanism to receive the projection when in the locked position.

21. A method as in claim 17, further comprising biasing the coupling mechanism in the locked position with a spring, and further comprising providing an extension on the locking mechanism to engage the spring.

22. A method as in claim 21, further comprising preventing rotation of the locking mechanism relative to the handle with a detent on the locking mechanism.

23. A barbell system, comprising:

a handle having a pair of ends;

a pair of end pieces which are receivable into each of the ends, the end pieces being adapted to couple a weight to the handle;

a releasable coupling mechanism at each of the ends, the coupling mechanism releasably coupling each end piece to the handle;

a locking mechanism receivable about the handle to lock the coupling mechanism in a locked position;

wherein the coupling mechanism comprises a collar and at least one ball disposed in the handle, wherein the collar forces the ball into engagement with the end piece when locked in the locked position, wherein the collar includes a stepped slot, and wherein the locking mechanism includes a locking projection which is receivable into the slot to lock the collar in the locked position; and a spring to bias the collar in the locked position, and wherein the locking mechanism includes an extension to engage the spring.

24. A barbell system, comprising:

a handle having a pair of ends;

a pair of end pieces which are receivable into each of the ends, the end pieces being adapted to couple a weight to the handle;

a releasable coupling mechanism at each of the ends, the coupling mechanism releasably coupling each end piece to the handle;

a locking mechanism receivable about the handle to lock the coupling mechanism in a locked position; and a fluted washer receivable over the handle to prevent removal of the coupling mechanism from the handle.

25. A method for making a barbell, the method comprising:

providing a handle having a pair of ends;

placing a locking mechanism about the handle;

inserting a coupling mechanism over the handle and biasing the coupling mechanism so that the coupling mechanism engages the locking mechanism in a locked position;

inserting a fluted washer about the handle after inserting the coupling mechanism, the fluted washer preventing removal of the coupling mechanism from the handle;

rotating the coupling mechanism until the locking mechanism is released;

inserting an end piece into the handle; and releasing the coupling mechanism to allow the coupling mechanism to return to the locked position.

26. A method for securing a weight to a barbell, the method comprising:

providing a handle having at least one end;

inserting an end piece through a hole in a weight;

inserting the end piece into the handle;

coupling the end piece to the handle with a coupling mechanism; and locking the coupling mechanism in a locked position to prevent unwanted release of the weight, and wherein the coupling mechanism is locked with a locking mechanism that is received about the handle and engages the coupling mechanism when in the locked position; and preventing removal of the coupling mechanism from the handle with a fluted washer that is received about the handle.

27. A barbell system, comprising:

a handle having a pair of ends;

a pair of end pieces which are receivable into each of the ends, the end pieces being adapted to couple a weight to the handle;

a coupling mechanism at each of the ends, the coupling mechanism releasably coupling each end piece to the handle;

a locking mechanism non-rotatably coupled about the handle, the locking mechanism including an extension projecting outward from the handle to lock the coupling mechanism in a locked position; and a spring to rotationally bias the collar in the locked position.

28. A method for securing a weight to a barbell, the method comprising:

providing a handle having at least one end;

inserting an end piece through a hole in a weight;

inserting the end piece into the handle;

coupling the end piece to the handle with a coupling mechanism; and locking the coupling mechanism in a locked position to prevent unwanted release of the weight, and wherein the coupling mechanism is locked with a locking mechanism that is received about the handle and engages the coupling mechanism when in the locked position, and wherein the coupling mechanism is unlocked by rotating the coupling mechanism relative to the locking mechanism and then moving the coupling mechanism toward a center of the handle; and further comprising biasing the coupling mechanism in the locked position with a spring, and further comprising providing an extension on the locking mechanism to engage the spring.

* * * * *